United States Patent [19]

Thaler

[11] 3,941,962

[45] Mar. 2, 1976

[54] GAS BLAST CIRCUIT BREAKER

[75] Inventor: Richard Thaler, Unterentfelden, Switzerland

[73] Assignee: Sprecher & Schuh AG, Aarau, Switzerland

[22] Filed: Nov. 29, 1973

[21] Appl. No.: 420,091

[30] Foreign Application Priority Data

| | | |
|---|---|---|
| Jan. 12, 1973 | Switzerland | 420/73 |
| Feb. 2, 1973 | Switzerland | 1548/73 |
| Feb. 2, 1973 | Switzerland | 1549/73 |

[52] U.S. Cl. ..... 200/148 A

[51] Int. Cl.[2] ..... H01H 33/70

[58] Field of Search ..... 200/148 A, 150 G

[56] References Cited

UNITED STATES PATENTS

| | | | |
|---|---|---|---|
| 3,679,851 | 7/1972 | Latour et al. | 200/148 A |
| 3,786,215 | 1/1974 | Mauthe | 200/148 A |

FOREIGN PATENTS OR APPLICATIONS

| | | | |
|---|---|---|---|
| 2,057,152 | 4/1971 | France | 200/148 A |

*Primary Examiner*—Robert S. Macon
*Attorney, Agent, or Firm*—Cushman, Darby & Cushman

[57] ABSTRACT

A gas blast circuit breaker has fixed and movable contact sets, the latter mounted on a cylinder slidable on a fixed piston to generate a gas blast on separation of the contact sets. Each contact set consists of radially inner and outer contacts, the inner contacts separating later than the outer. A gas blast nozzle mounted on the cylinder and between the radially inner and outer movable contacts has a throat downstream of the inner contact, communicating with the interior of the cylinder by way of an inner duct containing the inner contact, and an annular outer duct, so arranged that on separation of the contacts relatively cool fresh quenching gas is directed through the inner duct over the inner contact and arc.

12 Claims, 5 Drawing Figures

GAS BLAST CIRCUIT BREAKER

The invention relates to a gas blast circuit breaker of the kind having a fixed contact set and a moving contact set which latter comprises two coaxially disposed contact members which can be engaged with and disengaged from associated contact surfaces of the fixed contact set in timed sequence by means of a drive, and a blast nozzle of insulating material adapted to move with the movable contact set, the inlet of the said nozzle being connected to a quenching gas source, usually an integral pumping device, which can be actuated during the rupturing motion, the nozzle having its narrowest portion downstream (in the blast direction) with respect to the inner contact member, which is disengaged later in time during the rupturing motion.

It is generally known that an arc which results from the rupturing of an alternating current can be quenched by blowing with a quenching gas only when the current is close to zero phase or at zero phase itself. Blowing the arc while the current is at or near its peak value results in only a modest dissipation of the arc heat; however, during this time the quenching gas which is used for the blast is not only greatly expanded but it is also partly dissociated, and furthermore highly stressed vapours are developed in the region of the arc, which originate from the walls of the blast nozzle and more particularly from the burn zones of the contact surfaces.

These factors contribute to the generation of a conductive gas volume which is too large to be completely discharged through the narrowest portion of the blast nozzle. As a result pressure peaks occur in the nozzle during the time at which the current has its maximum values, the value of such pressure peaks greatly exceeding the quenching gas delivery pressure. As a consequence these conductive gases are forced back against the quenching gas blast. When the current subsequently diminishes the pressure in the nozzle also decays so that the quenching gas pressure again predominates and gas flow recommences in the desired blast direction. However, the ionized and conductive gases which have been forced against the blast will then again play on the still-burning arc and make no contribution to the effective quenching of the arc. Quenching can take place only when fresh, "unpolluted" quenching gas plays upon the arc as the latter approaches its unstable state (zero current phase).

Once the arc is extinguished it is necessary to prevent restriking thereof. However, restriking is substantially facilitated by the presence in the arc gap of ionized gas and vapour residues. In order to prevent restriking it is therefore important to keep ionized gases and vapours away from the arc gap.

These problems which occur in gas blast circuit breakers of the kind described hereinbefore are generally known and proposals have already been made in order to overcome these problems.

In a known circuit breaker of this kind (German Offenlegungsschrift No. 2,030,605) the overall cross-section of the gas passage between the gas blast pumping device and the inlet side of the blast nozzle is substantially smaller, or at most no greater, than the cross-section of the narrowest portion of the blast nozzle itself. The purpose of this proposal was evidently to provide a restrictor against the pressure surge which causes the backflow of polluted gas which would not entirely prevent the ingress of such gases into the pumping chamber but would ensure that such ingress would take place at a speed which was sufficiently high to ensure that the back-flowing ionized gases would be instantaneously mixed with fresh, unpolluted quenching gas and would thus be deionized. The restrictor however also acts against the flow in the intended blast direction, so that the pumping device itself must be able to supply a very high pressure in order to supply sufficient quenching gas to the quenching gap. Moreover, the blast nozzle of this known circuit breaker surrounds both the inner and the outer movable contact member. As a result the volumetric capacity of the nozzle chamber must be correspondingly large with the consequence that the delivery rate of the pumping device must also be great enough to flush the entire nozzle chamber with fresh quenching gas while the current decays and before it passes through zero phase.

In other known circuit breakers of the kind described hereinbefore, for example those disclosed in the Swiss patent specifications Ser. Nos. 414,793 and 471,456 or the U.S. Pat. No. 3,311,726, an attempt was made to solve the previously mentioned problems, by facilitating discharge of the highly stressed ionized gases in the blast direction and impeding flow in the reverse direction by special shaping of the diffuser of the blast nozzle which surrounds both movable contact members and/or by special shaping of the contact members themselves. These circuit breaker also call for a pumping device with a substantial output in order to achieve the desired effect.

It is an object of the present invention to provide a circuit breaker of the kind described hereinbefore, in which flow of part of the ionized gas against the blast direction is not prevented but is effectively restricted, and the arc gap is kept free from subsequent flow of this gas in the blast direction, using a pumping device with a comparatively low rating.

The invention resides in a gas blast circuit breaker having a stationary set of contact means and a movable set of contact means each set comprising radially inner and radially outer contact means, the radially inner contact means of the two sets being arranged to interengage and the radially outer contact means of the two sets being arranged to interengage; actuating means for moving the movable set of contact means, the radially outer contact means being arranged to be disengaged before the radially inner contact means disengage; and a blast nozzle of insulating material arranged to move with the movable contacts and having inlet means for receiving a pressurized quenching gas, which nozzle has a narrowest portion thereof disposed downstream (with respect to the direction of the quenching gas blast) of the radically inner movable contact means, is disposed between the radially inner and radially outer movable contact means, and contains upstream of its said narrowest portion of a radially inner first annular longitudinal quenching gas duct encircling the radially inner movable contact means whereby quenching gas in said duct will directly impinge on the said inner movable contact means, and a coaxial radially outer second annular longitudinal quenching gas duct.

The invention utilises the known phenomenon of pulsation of the cross-section of the arc (the plasma column) with the current. In other words, the cross-section of the arc at zero current — and immediately prior thereto — is a minimum so that sufficient space remains, even in the region of the narrowest portion of the blast nozzle, to eject the ionized gases previously forced back against to the blast, in good time and at a distance from the path of the constricted arc. Specifically, these ionized gases flow mainly or entirely through the outer coaxial duct and fresh quenching gas can flow through the inner coaxial duct into direct contact with the arc.

To this end the system may be arranged so that the blast inlet end of the inner duct is provided with at least one non-return valve which opens in the blast direction.

The movable contact members as well as the blast nozzle and the intermediate member defining the inner and outer ducts are preferably mounted on the outside of the end wall of a movable pumping cylinder which cooperates with a stationary pump piston to generate the gas blast. In this case it is desirable if the inside of the said terminal wall is attached to a tubular member which extends into the interior of the cylinder and is situated coaxially thereto and divides the cylinder into a radially inner and a radially outer part region at least at the end of the cylinder, the inlet to the non-return valve proceeding from the inner region and the inlet to the outer duct proceeding from the outer region, the end face of the pump piston being provided with an annular groove for receiving the tubular member on movement of the cylinder. In this embodiment it is advantageous if the volumetric capacity of the inner region is smaller than that of the outer region of the cylinder.

Further details and advantages of the invention are disclosed in the description hereinbelow of two exemplary embodiments of the invention which are illustrated in the accompanying drawing, in which.

Figure 1:
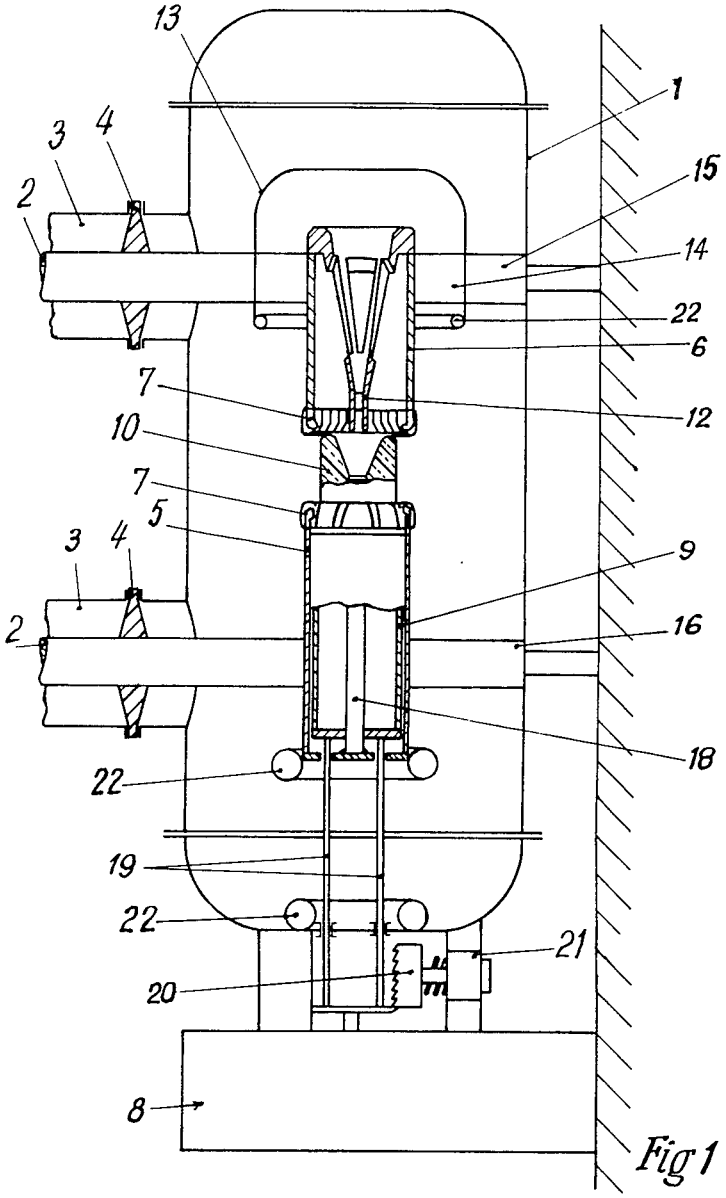
FIG. 1 is a cross-section through a gas blast circuit breaker.

The gas blast circuit breaker illustrated in FIG. 1 is disposed in a closed metal casing 1 filled with a gas, for example sulphur hexafluoride ($SF_6$) which is suitable as a quenching and insulating gas. The gas blast circuit breaker is connected by means of tubular ducts 2 to a switch gear system which is not shown. The ducts 2 are surrounded by sealing tight metal encapsulations 3 and are supported therein by means of disc insulators 4. The ducts 2 are electrically connected to electrically conductive cylinders 5 and 6 respectively. As will be described subsequently the cylinder 5 is associated with the moving contact set and the cylinder 6 is associated with the stationary contact set. The cylinders 5 and 6 are provided with respective sets of contact fingers 7 at their mutually facing ends. The stationary contact set comprises the fingers 7 on the cylinder 6, and a tubular central contact 12; the moving contact set comprises contact 9′ on the free end of the pumping cylinder 9, and a central contact pin 11. The contact fingers 7 of the cylinder 5 slidably engage the exterior surface of the cylinder 9, which carries current.

FIG. 1 shows the gas blast circuit breaker in the open position. When the circuit breaker is closed the two cylinder 5 and 6 are joined by a pumping cylinder 9 which is movable by means of a drive 8. When the circuit breaker is opened the pumping cylinder 9 is retracted together with a blast nozzle 10 of insulating material, which moves therewith. The central contact member 11 (FIGS. 2 and 3) of the moving contact set is disposed within the blast nozzle 10 as will be described subsequently and is electrically connected to the pumping cylinder 9. The outer contact 9′ encircles the blast nozzle. The central contact member 12 of the fixed contact set (FIGS. 2 and 3) which mates with the contact member 11, is mounted in the cylinder 6. During the rupturing motion the pumping cylinder 9 and the cylinder 6 are separated first, an arc being then established between the subsequently separating contact member 11 and 12. The arc will then burn in the nozzle chamber of the blast nozzle which is disposed on the one hand between the contact fingers 7 and on the other hand between the contact members 11 and 12. The hot and ionized gases are first ejected into the cylinder 6 whose upper end is open and is covered by a reversing hood 13. The said hot gases are cooled in the reversing hood 13 and are subsequently ejected into the interior of the metal casing 1.

Cooling fins may be provided on the cylinder 6 and/or on the reversing hood.

The reversing hood 13 is attached to the cylinder 6 by means of metal supports 14. The cylinder 6 which is provided with the reversing hood 13 is mounted in the metal casing 1 by means of a plurality of supporting insulators 15. The cylinder 5 is mounted in the metal casing 1 by means of supporting insulators 16. As may be seen by reference to FIGS. 2 and 3 a stationary pumping piston 17 is supported in the stationary cylinder 5 by means of a rod 18 of circular cross-section. The movable pumping cylinder 9 on the other hand is coupled to the drive 8 through insulating push rods 19 (FIG. 1). Known hydraulic or force accumulator drives may be used for the drive 8 and description thereof in this context is unnecessary. A non-return lock 20 which can be disengaged by an electromagnetic 21 during the make motion is provided in order to prevent a return motion of the push rods 19 and therefore of the moving contact set in the make direction during the rupturing motion. The reason for the possibility of return motion in the make direction during the rupturing motion will be explained subsequently.

Torus shaped electrodes 22, intended to reduce local field strength, are disposed on the cylinder 5 or in the casing 1 where the push rods 19 emerge from the casing.

Figure 2:
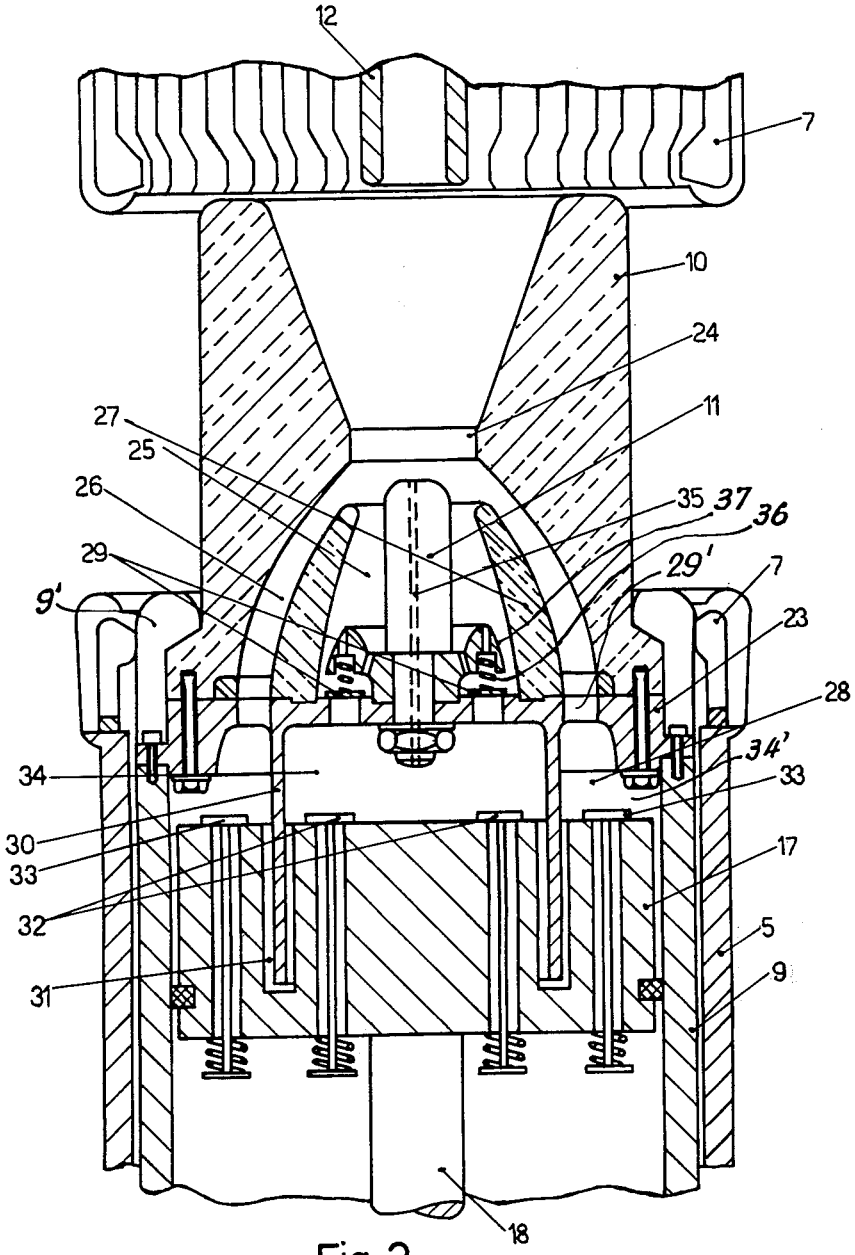
FIGS. 2 and 3 show axial cross-sections through a first embodiment of the contact sets and of the blast pumping device of the gas blast circuit breaker of FIG. 1, in the open and closed positions respectively.
Figure 3:
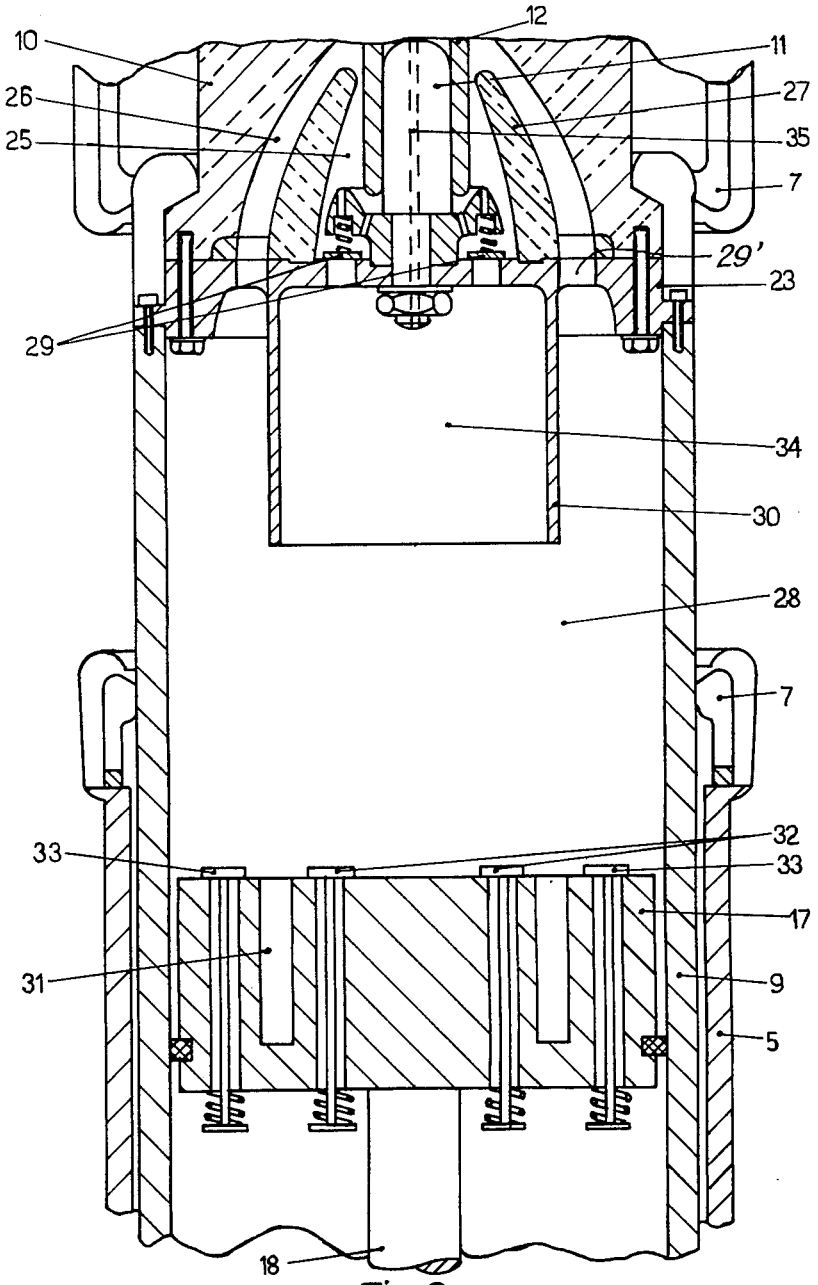

From FIGS. 2 and 3 it will be seen that the contact member 1 is mounted together with the blast nozzle 10 on an intermediate plate 23. The free end of the contact member 11, which functions as a consumable surface, is disposed upstream of the narrowest portion or throat 24 of the blast nozzle 10, relative to the blast direction. The nozzle chamber of the blast nozzle 10 which is disposed upstream of the throat 24 is divided by a tapered tubular intermediate member 27 into two coaxial ducts 25 and 26 of which the inner duct 25 surrounds the contact member 11 practically over its entire length. The inner duct 25 is connected via a non-return valve 29 to the delivery side of the pumping cylinder chamber 28 while the outer duct 26 is directly connected to the said chamber 28 via ports 29′. A tubular cylindrical partitioning apron 30, which divides the pumping cylinder chamber 28 into two delivery chambers 34 and 34′ during the last portion of the return stroke of the pumping cylinder 9, is mounted on the side of the intermediate plate 23 which is nearer to the pumping cylinder chamber 28. Ports 29' extend from the delivery chamber 34' and inlet ports extend from the delivery chamber 34 to the non-return valves 29. This ensures that the polluted, hot gases can be forced back during the rupturing motion only through the ports 29' into the delivery chamber 34', and cannot enter the delivery chamber 34 which feeds the inner duct 25. An annular groove 31 is formed in the free end face of the stationary pumping cylinder 7 facing the plate 23, to accommodate the apron 30 at the end of the operating stroke.

Inflow of fresh gas into the pumping cylinder chamber 28 during the make operation is made possible by inlet valves which are provided in the stationary pumping piston 17 and are also constructed as non-return valves 32 and 33. It should be noted that the volumetric capacity of the delivery chamber 34 is less than that of the delivery chamber 34' and that the non-return valve 29 is a spring-biased flutter valve normally held closed by a spring or springs 36 seated on a fixed collar 37.

FIG. 3 shows the contact members 11 and 12 of the circuit breaker in the closed state. The greater part of the current flows via the pumping cylinder 9 from the contact fingers 7 of the stationary contact set (cylinder 6) to the contact fingers 7 of the cylinder 5. The contact members 11 and 12 which are engaged with each other also carry current but only to a negligible degree compared with the wall of the pumping cylinder 9.

At the beginning of the rupturing motion the upper, free end of the pumping cylinder 9 is separated from the contact fingers 7 of the stationary contact set. At this moment the entire current will flow via the contact members 11 and 12 only. Practically no gas is able to escape from the pumping cylinder chamber 28 until these contact members are separated, because the valves 32 and 33 are closed and the throat 24 of the blast nozzle 10 is closed by the contact member 12. The gas in the pumping cylinder chamber 28 is therefore precompressed. As the pumping cylinder 9 continues to move in the rupturing direction (downwardly in FIG. 3) the contact members 11 and 12 are separated and a short arc is initially established in the blast nozzle 10. This short arc is elongated when the rupturing motion stops. The pressure which develops in the nozzle chamber of the blast nozzle 10 depends on the instantaneous value of the current which flows in the arc and also depends on the length of the arc. No gas can be supplied from the pumping chamber 28 to the blast nozzle when the pressure in the nozzle chamber of the blast nozzle 10 reaches or exceeds the instantaneous pressure in the chamber 28. Instead, the hot and ionized gases are forced back into the ducts 25 and 26 and only the gas which is forced back into the duct 26 is able to enter the pumping cylinder chamber 28. The resulting rise in pressure, which is produced in the pumping cylinder chamber 28 may overcome the force applied by the drive 8 and thus may thrust the pumping cylinder 9 back in the direction opposite to the rupturing motion, that is to say in the make direction. The non-return lock 20 is provided to prevent such reversal of the motion of the pumping cylinder 9 during the rupturing operation and therefore to avoid having to provide a drive 8 of an unnecessarily large rating.

As the cylinder 9 moves, the cylindrical apron plunges into the annular groove 31. The length of the apron is such that this occurs when the distance between the contact members 11 and 12 is that at which it is to be expected that displacement of the hot and ionized gases from the nozzle chamber of the blast nozzle 10 into the chamber 28 is most marked, that is to say at the maximum value of the current which is to be interrupted. As already mentioned, the hot gases cannot be forced back into the delivery chamber 34 because they are prevented from so doing by the non-return valve 29. The hot gases can be forced back through the outer duct 26 and through the ports 29' into the delivery chamber 34' but the latter is now separated from the delivery chamber 34 by the apron 10 engaging the groove 31. The gases which are forced back into the delivery chamber 34' are therefore unable to pollute the still pure gas in the delivery chamber 34. The pumping cylinder 9, which has meanwhile been retained by the non-return lock, continues its rupturing motion as soon as the instantaneous pressure in the nozzle chamber of the blast nozzle 10 diminishes because the current which is to be interrupted approaches zero phase. The ionized gases are then blown back into the nozzle chamber from the delivery chamber 34' through the ports 29' and the outer duct 26. Fresh unpolluted gas flows simultaneously from the delivery chamber 34 through the non-return valve 29 into the inner duct 25 and come into direct contact with the contact member 11 and the arc extending therefrom which will then have a diminishing current flow. This results in a separation between polluted gases and fresh gases in the nozzle chamber of the blast nozzle 10. The fresh gas flushes around the base of the arc, which has a very small diameter near zero phase, and flows approximately in the middle of the nozzle chamber of the blast nozzle 10. The polluted gases on the other hand cover the internal wall of the nozzle chamber of the blast nozzle 10 but do not interfere with the quenching operation because only small nozzle cross-sections are required for extinguishing small arcs (that is to say low currents and a plasma column of small diameter). When the arc is close to zero current phase it is intensively blown only with fresh extinction gas from the delivery chamber 34 during the entire rupturing motion.

Accordingly it is possible to interrupt far higher currents than would be possible with current breakers of the kind disclosed by the prior art, with comparable dimensions for the contact members, the pumping device and the drive 8.

A capillary bore 35 with a diameter of the order of magnitude of 1 mm extends approximately centrally through the contact member 11. The purpose of the capillary bore 35 is to centre the arc. The diameter of the said bore is so small as to practically prevent hot ionized gases being forced through it back into the delivery chamber 34. The cross-sectional area of the bore 35 should be not more than 5% of the total cross-sectional area of the ducts 25 and 26 at their narrowest portions.

When the illustrated gas blast circuit breaker is closed, the two contact members 11 and 12 touch first and subsequently the pump cylinder 9 connects the contact fingers 7 of the fixed and moving contact sets respectively. During this make motion the non-return valves 32, 33 also open and allow new, fresh gas to flow from the interior of the metal casing 1 into the pump cylinder chamber 28.

Figure 4:
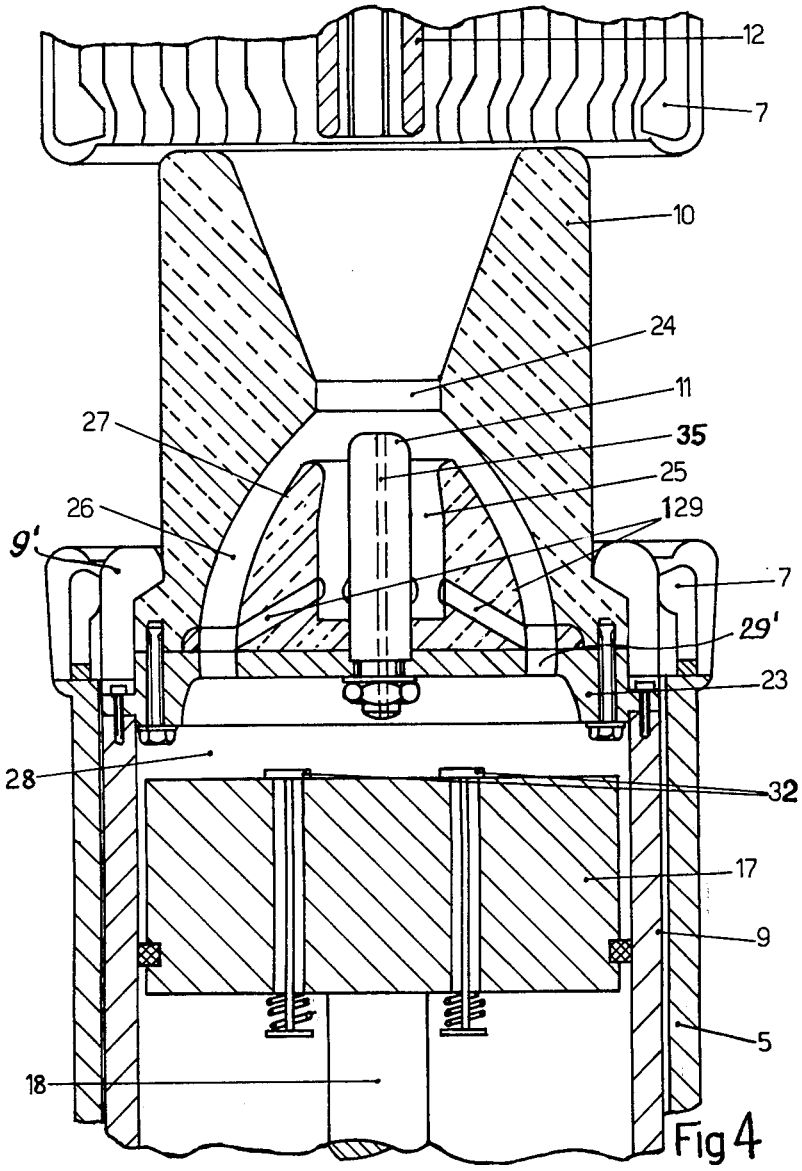
FIGS. 4 and 5 show cross-sections through a further embodiment of the contact sets and the pumping device of the gas blast circuit breaker, in the open and closed positions respectively.
Figure 5:
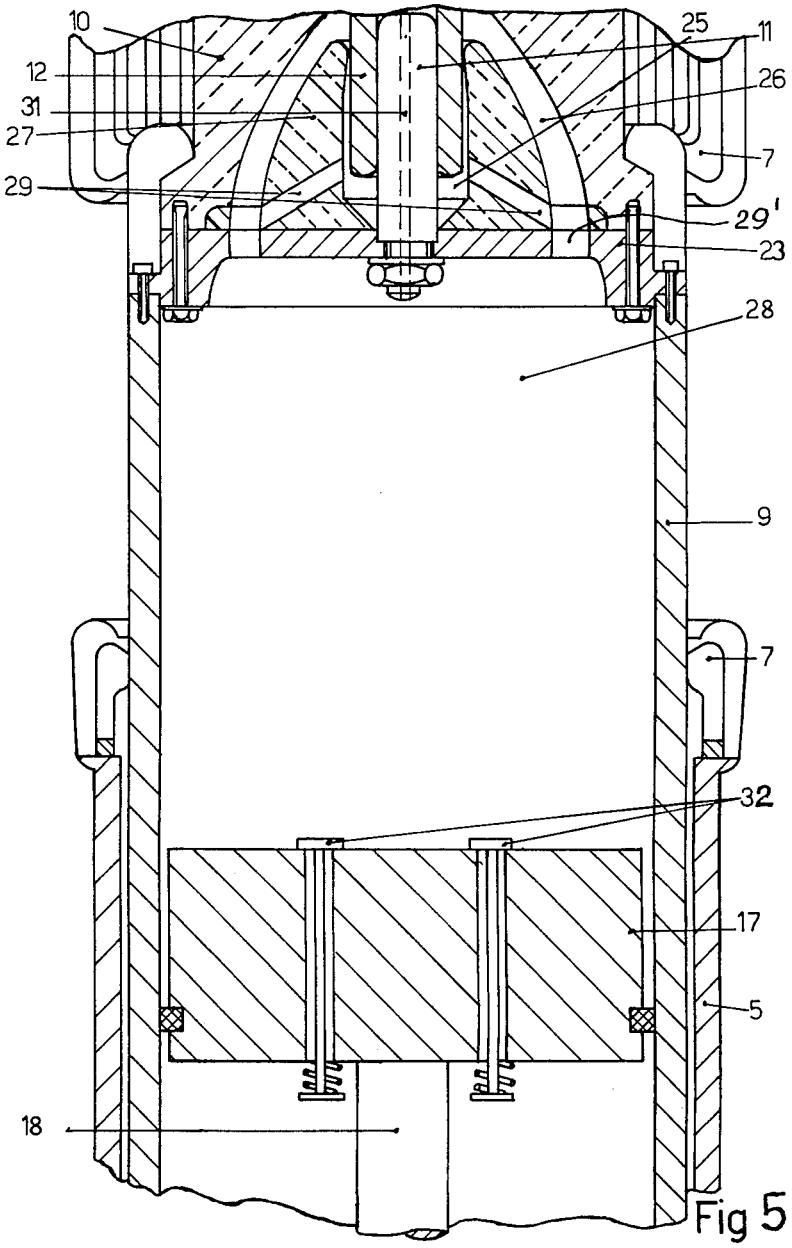

The embodiment illustrated in FIGS. 4 and 5 is of simpler construction than that of FIGS. 2 and 3. The contact member 11 is surrounded by the blast nozzle 10, and both are mounted on the intermediate plate 23, and the intermediate member 27 which subdivides the nozzle chamber, upstream of the throat 24, into the two ducts 25 and 26 is also provided on the intermediate plate 23. However the blast inlet end of the inner nozzle duct 25 of this embodiment communicates through ports 129 with the blast inlet end of the duct 26 which in turn communicates via the ports 29' with the pump cylinder chamber 28. The non-return valves 29, the cylindrical apron 30 and the associated groove 31 in the pump piston 17 are all omitted in this embodiment, and the pump piston 17 is provided with only one set of non-return valves or suction valves 32.

However, the method of operation of the embodiment illustrated in FIGS. 4 and 5 differs from that of the embodiment of FIGS. 2 and 3 only in detail. The hot, ionized gases are again forced back mainly through the outer duct 26 because the inner duct 25 functions as a blind alley even though the ports 129 are provided. As soon as the pressure in chamber 28 again exceeds that in the nozzle chamber, the gases previously forced into the chamber 28, which are polluted except insofar as they have been cooled and de-ionized in the chamber 28, the blown back through the ports 29' and, mainly through the outer duct 26, over the arc, whose diameter is by this stage decreasing. Fresh unpolluted quenching gas will then flow from the pumping cylinder chamber 28, with an increasing pressure gradient so that the inner duct 25 as well as the outer duct 26 will be supplied with fresh, unpolluted quenching gas via the ports 129. The arc, of diminishing diameter, will then be blown with increasingly fresh quenching gas, and remains centered by a small gas stream which flows through the capillary bore 35.

I claim:

1. A gas blast circuit breaker having a stationary set of contact means and a movable set of contact means, each said set comprising radially inner and radially outer contact means, the radially inner contact means of the two sets being arranged to interengage and the radially outer contact means of the two sets being arranged to interengage; actuating means for moving the movable set of contact means, the radially outer contact means being arranged to be disengaged before the radially inner contact means disengage; and a blast nozzle of the insulating material, arranged to move with the movable contacts and having inlet means for receiving a pressurized quenching gas from a gas pressure chamber, which nozzle has a narrowest portion thereof disposed downstream with respect to the direction of the quenching gas blast of the end of the radially inner movable contact means and disposed between the radially inner and radially outer movable contact means, said blast nozzle comprising upstream of its said narrowest portion a radially inner first annular longitudinal quenching gas duct encircling the radially inner movable contact means whereby quenching gas in said first duct will be directly impinge on and flow along the said inner movable contact means, and a coaxially outer second annular longitudinal quenching gas duct, merging with said first annular quenching gas duct in the range of the free end of the radially inner movable contact means, further means being provided at the inlet end of said first annular longitudinal duct for preventing direct back flow from said first annular duct into said gas pressure chamber.

2. A circuit breaker as claimed in claim 1 wherein said further means at the inlet end of said first duct is at least a non-return inlet valve arranged to permit gas flow in the direction of the gas blast only.

3. A circuit breaker as claimed in claim 2 in which the movable contact set is associated with pumping means arranged to compress a body of quenching gas on movement of the movable contact set to disengage the contact means, the pumping means comprising said gas pressure chamber communicating with the inlet means of the said blast nozzle.

4. A circuit breaker as claimed in claim 3 wherein the pumping means consists of a movable cylinder and a stationary piston therein, said gas pressure chamber being defined between the piston and an end wall of the cylinder adjoining the blast nozzle.

5. A circuit breaker as claimed in claim 4 wherein the pumping cylinder carries at the said end of the blast nozzle and the movable contact means.

6. A circuit breaker as claimed in claim 4 wherein the said end wall of the pumping cylinder is provided with a tubular partition extending from the said end wall towards the piston and dividing the end region of the gas pressure chamber into a radially inner and a radially outer portion, which portions communicate respectively with the first duct via the non-return valve or valves and with the second duct, the piston being provided with an annular recess arranged to receive the said partition during movement of the cylinder on disengagement of the contact means.

7. A circuit breaker as claimed in claim 6 wherein the volume of the said inner portion is less than that of the said outer portion.

8. A circuit breaker as claimed in claim 1 wherein ingress of quenching gas to the first duct is provided by transverse ports connecting the blast inlet end of the first duct to the blast inlet end of the second duct.

9. A circuit breaker as claimed in claim 8 in which the transverse ports converge towards one another in the direction of the blast.

10. A circuit breaker as claimed in claim 1 wherein the inner contact means of the movable contact set is a single consumable contact pin, which pin is provided with an axial capillary bore for flow of quenching gas to the tip of the pin.

11. A circuit breaker as claimed in claim 10 wherein the cross-sectional area of the capillary bore is not more that 5% of the total cross-sectional area of the first and second ducts at the narrowest portions thereof.

12. A circuit breaker as claimed in claim 1 including a non-return mechanism arranged to prevent reversal of the disengaging movement of the movable contact set.

* * * * *